US010082376B1

(12) United States Patent
Thomas et al.

(10) Patent No.: US 10,082,376 B1
(45) Date of Patent: Sep. 25, 2018

(54) PENETRATING AND FRAGMENTING PROJECTILE

(71) Applicant: Lockheed Martin Corporation, Bethesda, MD (US)

(72) Inventors: Toby D. Thomas, Southlake, TX (US); James C. Copp, Arlington, TX (US); Kenneth Havens, Crowley, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 15/094,718

(22) Filed: Apr. 8, 2016

(51) Int. Cl.

| | |
|---|---|
| ***F42B 10/00*** | (2006.01) |
| ***F42B 12/00*** | (2006.01) |
| ***F42B 30/00*** | (2006.01) |
| ***F42B 12/02*** | (2006.01) |
| ***F42B 33/00*** | (2006.01) |

(52) U.S. Cl.
CPC ..... *F42B 12/02* (2013.01); *F42B 33/00* (2013.01)

(58) Field of Classification Search
CPC .. E21B 43/117; F42B 1/02; F42B 3/08; F42B 12/10
See application file for complete search history.

(56) References Cited

U.S. PATENT DOCUMENTS 2,364,643 A * 12/1944 Moore ..... F42B 12/204 102/499
2,396,978 A * 3/1946 Amthor ..... F42C 1/02 102/500
2,796,833 A * 6/1957 Sweetman ..... E21B 43/116 102/306
3,498,222 A * 3/1970 Birkigt ..... F42B 12/06 102/518
4,245,557 A * 1/1981 Knappworst ..... F42B 12/34 102/508
4,256,039 A * 3/1981 Gilman ..... F42B 12/06 102/517
4,574,702 A * 3/1986 Brandt ..... F42B 10/48 102/244
4,708,063 A * 11/1987 Ladriere ..... F42B 10/00 102/516
5,440,994 A * 8/1995 Alexander ..... F42B 5/03 102/439
5,767,438 A * 6/1998 Lang ..... F42B 5/025 102/439
(Continued)

*Primary Examiner* — Samir Abdosh
(74) *Attorney, Agent, or Firm* — Withrow & Terranova, PLLC

(57) ABSTRACT

A projectile has a liner forming an interior void, and a core disposed in a first region of the void proximal to a trailing end portion of the liner, with a portion of the void disposed forward with respect to the core. An outer jacket covers a leading end portion of the liner to enclose the interior void. When the projectile impacts a target object, the core travels in a direction of flight through the leading end portion of the liner to impact the object. When the projectile impacts a target surface at a non-zero angle of approach with respect to the normal of the target surface, the projectile creates a deformation in the target surface immediately before the core travels through the leading end portion of the liner to impact the target. This deformation reduces the probability that the core will ricochet off the deformed portion of the surface.

19 Claims, 14 Drawing Sheets

(56) References Cited

U.S. PATENT DOCUMENTS

| | | | | |
|---|---|---|---|---|
| 5,852,255 | A * | 12/1998 | Hallis | F42B 8/14 102/398 |
| 6,112,669 | A * | 9/2000 | Mravic | F42B 12/74 102/501 |
| 6,186,072 | B1 * | 2/2001 | Hickerson, Jr. | F42B 12/06 102/517 |
| 7,455,015 | B2 * | 11/2008 | Krstic | F42B 12/74 102/439 |
| 8,250,987 | B1 * | 8/2012 | Morley | F42B 10/48 102/438 |
| 9,482,499 | B1 * | 11/2016 | Gotzmer | F42B 1/028 |
| 2005/0056459 | A1 * | 3/2005 | Haney | E21B 43/117 175/4.6 |
| 2008/0035008 | A1 * | 2/2008 | Riess | F42B 12/06 102/518 |
| 2012/0216699 | A1 * | 8/2012 | Fanucci | F42B 12/06 102/473 |
| 2014/0326158 | A1 * | 11/2014 | Fritz | F42B 5/025 102/524 |
| 2016/0282097 | A1 * | 9/2016 | Henry, III | F42B 12/74 |

* cited by examiner

PENETRATING AND FRAGMENTING PROJECTILE

TECHNICAL FIELD

The embodiments relate generally to a projectile and, in particular to a penetrating and fragmenting projectile.

BACKGROUND

It is desirable for projectiles, such as small arms ammunition, for example, to have the capability of penetrating and fragmenting upon impact with a target, thereby increasing the effectiveness and lethality of the projectile. It is difficult, however, to design a projectile that has superior penetration as an angle of approach increases with respect to a normal of a target surface. It is also difficult to design a projectile that fragments in a controlled and predictable manner.

Some projectiles employ a dense metal core in order to provide a projectile having an increased momentum on impact, thereby increasing penetration capability of the projectile, but such projectiles may still ricochet off a target as the angle of approach increases. Another disadvantage of conventional projectiles is that many types of commonly used metals, such as lead or spent uranium-238, can have long term toxic and/or environmentally harmful effects.

Some projectiles may also use a secondary explosive charge to cause fragmentation on impact with a target, but these types of projectiles tend to have limited penetration capabilities. The material used for the explosive charge may also have toxic and/or environmentally harmful effects. Accordingly, there is a need in the art for a projectile with superior penetrating and fragmenting capabilities.

SUMMARY

Embodiments include a projectile comprising a liner forming an interior void, and a core disposed in a first region of the void proximal to a trailing end portion of the liner, with a portion of the void disposed forward with respect to the core. An outer jacket covers a leading end portion of the liner to enclose the interior void. When the projectile impacts a target object, the core travels in a direction of flight through the leading end portion of the liner to impact the object. For example, in one embodiment, the projectile impacts a target surface at a non-zero angle of approach with respect to the normal of the target surface. The projectile creates a deformation in the target surface immediately before the core travels through the leading end portion of the liner to impact the target. This deformation causes a portion of the target surface impacted by the core to have a normal that is at a smaller angle with respect to the direction of flight of the core. This, in turn, reduces the angle of approach of the core with respect to the target surface and reduces the probability that the core will ricochet off the deformed portion of the surface. In addition, the liner may be configured to fragment outwardly from the core as the core travels through the leading end portion of the liner, which further enhances the lethality of the projectile.

In one embodiment, a projectile is disclosed. The projectile comprises a liner comprising a liner leading end portion and a liner trailing end portion and having a longitudinal axis. The liner forms an interior void having a first void region, the first void region having a first void cross-sectional diameter perpendicular to the longitudinal axis, a first void length, and a first void volume. The projectile further comprises a core disposed in the first void region proximal to the liner trailing end portion. The core has a maximum core cross-sectional diameter no greater than the first void cross-sectional diameter, a core length less than the first void length, and a core volume less than the first void volume. The projectile further comprises an outer jacket covering the liner leading end portion.

In another embodiment, a projectile is disclosed. The projectile comprises a liner having a liner leading end portion, the liner forming an interior void. The projectile further comprises a core disposed in the interior void, the core configured to impact the liner leading end portion in response to the projectile impacting an object. The core is configured to impact the liner leading end portion after the projectile impacts the object.

In another embodiment, a method of assembling a projectile is disclosed. The method comprises providing a liner comprising a liner leading end portion and a liner trailing end portion and having a longitudinal axis. The liner forms an interior void having a first void region. The first void region has a first void cross-sectional diameter perpendicular to the longitudinal axis, a first void length, and a first void volume. The method further comprises inserting a core into the first void region at the liner trailing end portion. The core has a maximum core cross-sectional diameter no greater than the first void cross-sectional diameter. The core has a core length less than the first void length, and the core has a core volume less than the first void volume. The method further comprises inserting the liner leading end portion into an outer jacket to cover the liner leading end portion.

Those skilled in the art will appreciate the scope of the disclosure and realize additional aspects thereof after reading the following detailed description of the embodiments in association with the accompanying drawing figures.

BRIEF DESCRIPTION OF THE DRAWINGS

The accompanying drawing figures incorporated in and forming a part of this specification illustrate several aspects of the disclosure and, together with the description, serve to explain the principles of the disclosure.

DETAILED DESCRIPTION

The embodiments set forth below represent the information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Any flowcharts discussed herein are necessarily discussed in some sequence for purposes of illustration, but unless otherwise explicitly indicated, the embodiments are not limited to any particular sequence of steps. The use herein of ordinals in conjunction with an element is solely for distinguishing what might otherwise be similar or identical labels, such as "first void region" and "second void region," and does not imply a priority, a type, an importance, or other attribute, unless otherwise stated herein. The term "substantially" used herein in conjunction with a numeric value means any value that is within a range of five percent greater than or five percent less than the numeric value.

As used herein and in the claims, the articles "a" and "an" in reference to an element refers to "one or more" of the element unless otherwise explicitly specified.

Embodiments include a projectile comprising a liner forming an interior void, and a core disposed in a first region of the void proximal to a trailing end portion of the liner, with a portion of the void disposed forward with respect to the core. An outer jacket covers a leading end portion of the liner to enclose the interior void. When the projectile impacts a target object, the core travels in a direction of flight through the leading end portion of the liner to impact the object. For example, in one embodiment, the projectile impacts a target surface at a non-zero angle of approach with respect to the normal of the target surface. The projectile creates a deformation in the target surface immediately before the core travels through the leading end portion of the liner to impact the target. This deformation causes a portion of the target surface impacted by the core to have a normal that is at a smaller angle with respect to the direction of flight of the core. This, in turn, reduces the angle of approach of the core with respect to the target surface and reduces the probability that the core will ricochet off the deformed portion of the surface. In addition, the liner may be configured to fragment outwardly from the core as the core travels through the leading end portion of the liner, which further enhances the lethality of the projectile.

Figure 1:
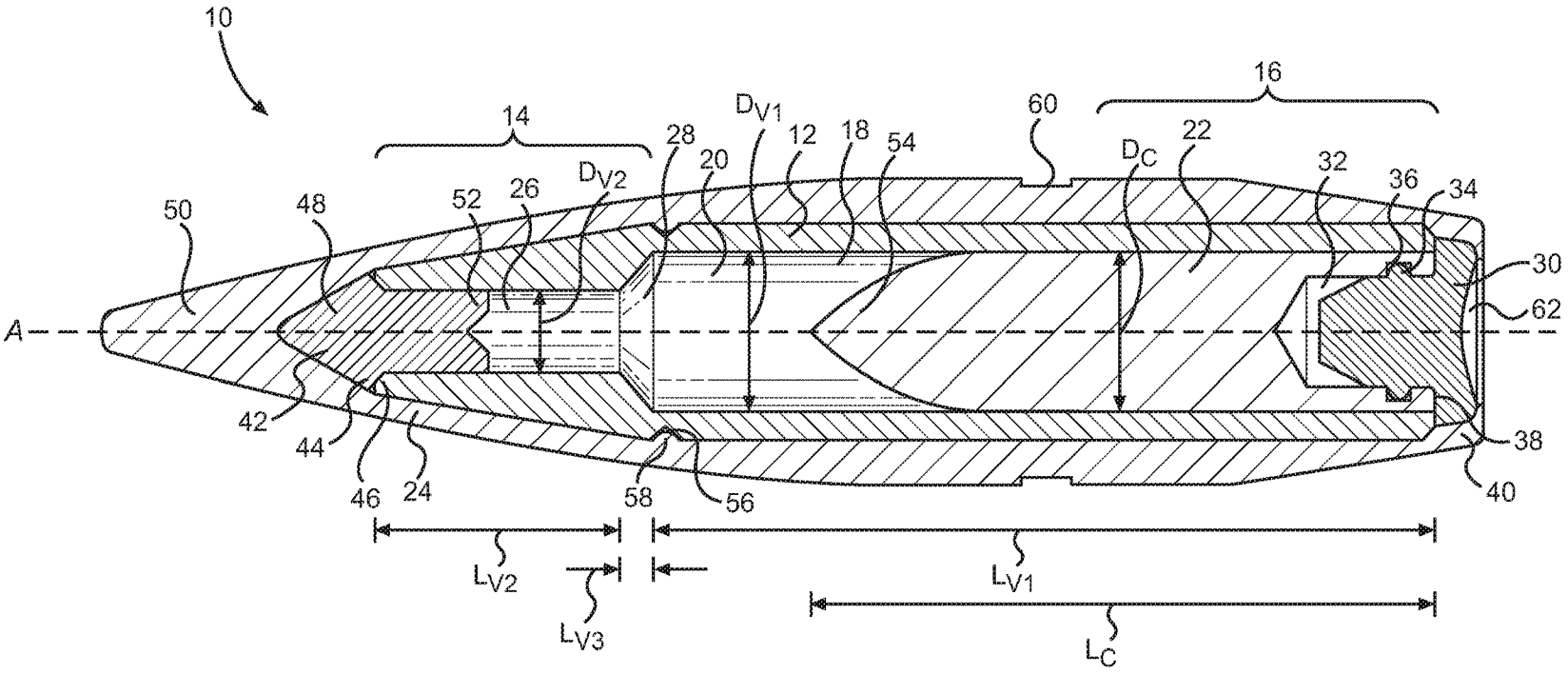
FIG. 1 illustrates a cross-sectional side view of a projectile having a liner and a core disposed in a void of the liner according to an embodiment.

In this regard, FIG. 1 illustrates a cross-sectional side view of a projectile 10 according to an embodiment. The projectile 10 comprises a liner 12 comprising a liner leading end portion 14 and a liner trailing end portion 16 and having a longitudinal axis A, the liner 12 forming an interior void 18 having a first void region 20. The first void region 20 has a first void cross-sectional diameter $D_{V1}$ perpendicular to the longitudinal axis A and a first void length $L_{V1}$. In this embodiment, the first void region 20 has a cylindrical profile, with the first void cross-sectional diameter $D_{V1}$ and first void length $L_{V1}$ defining a first void volume $V_{V1}$ equal to $(L_{V1}*D_{V1}^{2}*\pi)/4$.

A core 22 is disposed in the first void region 20 proximal to the liner trailing end portion 16. The core 22 has a maximum core cross-sectional diameter $D_C$ that is no greater than the first void cross-sectional diameter $D_{V1}$, and a core length $L_C$ less than the first void length $L_{V1}$. As a result, a core volume $V_C$ is less than the first void volume $V_{V1}$, so that the core 22 does not occupy the entire first void region 20. In this embodiment, the maximum core diameter $D_C$ is substantially equal to the first core diameter $D_{V1}$, but it should be understood that the tolerances of the liner 12 and the core 22 may be customized to allow for a tighter or looser fit, as desired.

An outer jacket 24 covers the liner leading end portion 14 to enclose the void 18 at the liner leading end portion 14 of the projectile 10. When the projectile 10 impacts a target object, the core 22 is configured to travel in a direction of flight through the liner leading end portion 14 to impact the target object (not shown). For example, as will be discussed in greater detail with respect to FIGS. 3A-3D below, the core 22 in this embodiment travels in the direction of flight through the void 18 as the liner leading end portion 14 of the liner 12 deforms and fragments in response to the initial impact. The fact that the core 22 does not occupy the entire void 18 results in a delay between the initial impact of the projectile 10 and the secondary impact of the core 22 against the target object. This delay allows the initial impact of the projectile 10 to weaken the target object immediately before the secondary impact of the core 22, thereby increasing the chances that the core 22 will penetrate, e.g., "punch through," the target object.

In this embodiment, the void 18 includes both the first void region 20 and a second void region 26 proximal to the liner leading end portion 14. The second void region 26 has a second void cross-sectional diameter $D_{V2}$ perpendicular to the longitudinal axis A, with the second void cross-sectional diameter $D_{V2}$ being less than the maximum core cross-sectional diameter $D_C$ of the core 22.

A tapering transition void region 28 is disposed between the first void region 20 and the second void region 26 in this embodiment. The transition void region 28 defines a truncated conical volume having the diameter $D_{V1}$ at an interface between the first void region 20 and the transition void region 28, tapering to the diameter $D_{V2}$ at the interface between the second void region 26 and the transition void region 28. In this embodiment, as the core 22 travels in a direction of flight in response to the projectile 10 impacting a target object, the core 22 passes through the second void region 26 as the core 22 travels through the liner leading end portion 14 to impact the target object. In doing so, the core 22 expends and fragments the liner leading end portion 14 before impacting the target object.

In this embodiment, prior to the projectile 10 impacting the target object, the core 22 is retained in place at the liner trailing end portion 16 by a plug 30 disposed in a core void 32 of the core 22. In this embodiment, a plug retention ring 34 is received by a core retention groove 36 in the core void 32, to retain the plug 30 in the core void 32. A radially extending plug stop surface 38 retains the core 22 and the plug 30 at the liner trailing end portion 16 of the liner 12, prior to the projectile 10 impacting the target object. In this embodiment as well, the jacket 24 includes a crimped trailing end 40 that is crimped around a portion of the plug 30 after the core 22 and the plug 30 are inserted into the liner trailing end portion 16. In this manner, the crimped trailing end 40 of the jacket 24 prevents removal of the core 22 and plug 30 from the liner trailing end portion 16 subsequent to assembly of the projectile 10. When the projectile 10 impacts the target object, the momentum of the core 22 is sufficient to release the plug 30 from the core void 32, such as, for example, by the core retention groove 36 compressing and/or shearing away the plug retention ring 34 in response to the initial impact. In this manner, the core 22 can be secured at the liner trailing end portion 16 during assembly of the projectile 10, while still allowing the core 22 to travel in the direction of flight through the void 18 and the liner leading end portion 14 in response to the projectile 10 impacting a target object. In this embodiment, the jacket 24 may be formed from a relatively soft, low-density material such as copper, with the liner 12 being formed from a material, such as steel, having relatively higher hardness than the jacket 24 material. This arrangement allows the soft copper jacket 24 to compress and erode away from the liner leading end portion 14 following the initial impact of the projectile 10 against the target object.

In this embodiment, a steel cap 42 is also provided to prevent portions of the jacket 24 from being forced into the second void region 26 during the initial impact. The cap 42 may be formed from the same type of steel as the liner 12, having the same hardness and density properties for example, or may be formed from a different type of steel or other material having different density and hardness properties, for example. The cap 42 is at least partially disposed in the second void region 26 with a flared portion 44 of the cap 42 abutting a leading end stop surface 46 of the liner leading end portion 14, thereby positioning a cap leading end portion 48 between the second void region 26 and a jacket leading end portion 50 of the jacket 24. The tapered profile of the cap leading end portion 48 deflects the jacket leading end portion 50 away from the longitudinal axis A toward and along an outer surface of the liner leading end portion 14 of the liner 12 as the jacket leading end portion 50 deforms and fragments. In this embodiment, the cap 42 is a relatively brittle steel, which is configured to cause the cap 42 to shatter during the initial impact of the projectile 10 against the target object. This permits the relatively dense core 22, which is formed from tungsten in this embodiment, to more easily displace the shattered fragments of the cap 42 when the core 22 reaches a cap trailing end 52 of the cap 42. In this embodiment, the core 22 has a tapered core leading end portion 54 configured to facilitate the core 22 traveling through the void 18 and liner leading end portion 14, as well as enhancing the ability of the core 22 to penetrate the target object.

In this embodiment, the liner 12 also includes a circular liner retention groove 56 extending around the liner 12 proximal to the liner leading end portion 14. The liner retention groove 56 has two functions. First, the liner retention groove 56 is configured to interface with a jacket retention ring 58, to retain the liner 12 within the jacket 24 during assembly of the projectile 10. Second, the liner retention groove 56 enhances the fragmentation properties of the liner leading end portion 14 by providing a weakened portion of the liner leading end portion 14 to fragment the liner leading end portion 14 in a controlled manner, in response to the core 22 traveling through the liner leading end portion 14.

The projectile 10 in this example has a jacket retention groove 60 formed in the jacket 24 and configured to matingly engage with a complimentary feature of a cartridge case (not shown), described in greater detail below with respect to FIG. 2. In this embodiment, the plug 30 also includes a trailing end concave portion 62 configured to efficiently transfer explosive energy of an explosive charge disposed in the cartridge case (not shown) into kinetic energy of the projectile 10.

Figure 2:
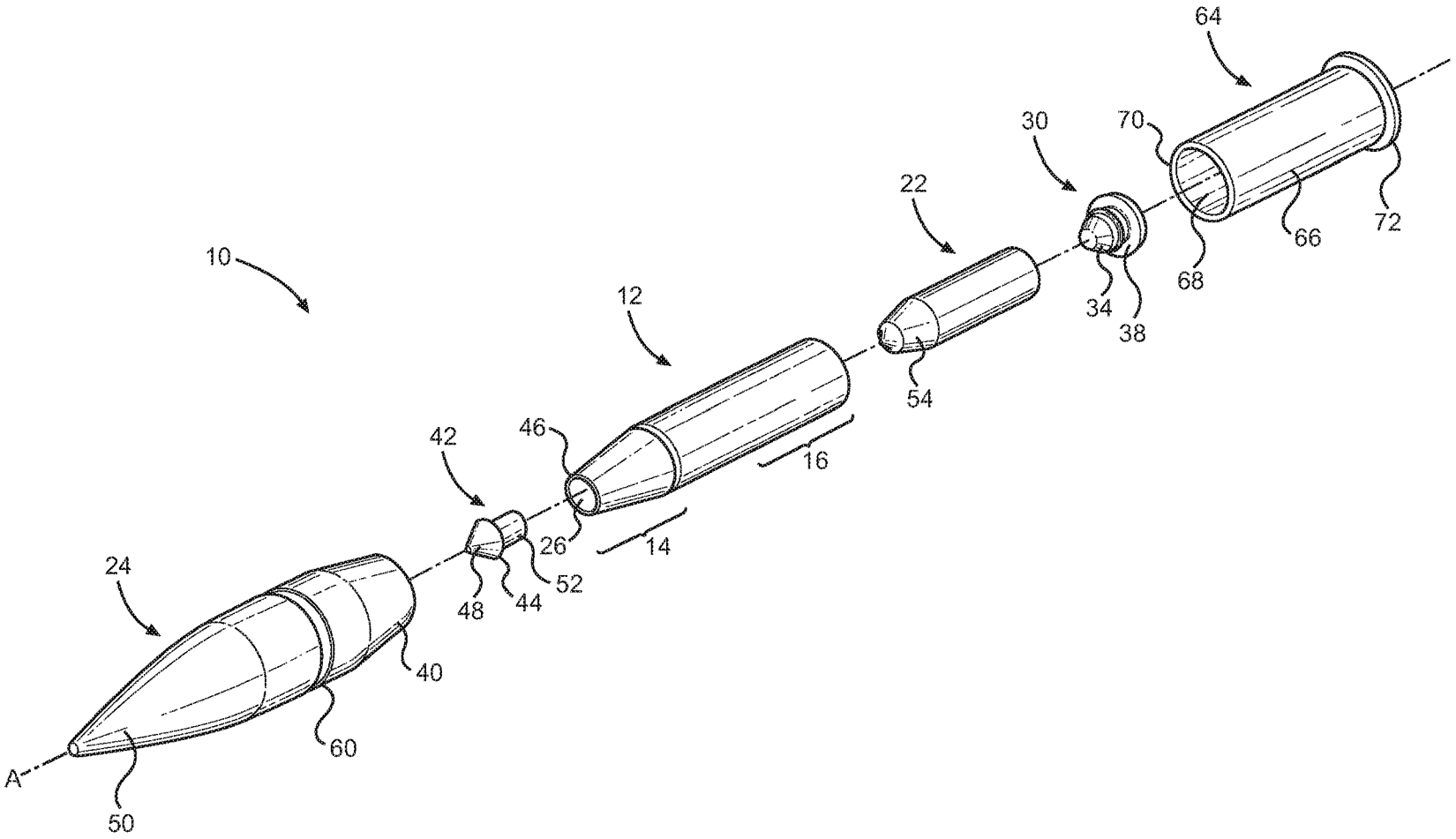
FIG. 2 illustrates an exploded isometric view of the projectile of FIG. 1 illustrating assembly of the projectile and insertion of the projectile into a cartridge case.

In this regard, FIG. 2 illustrates an exploded isometric view of the projectile 10 of FIG. 1, illustrating assembly of the projectile 10 and insertion of the projectile 10 into a cartridge case 64. In this example, the cap 42 may first be inserted into the liner leading end portion 14 of the liner 12, and the plug 30 may be inserted into the core void 32 of the core 22. Next, the liner 12 may be inserted into the jacket 24, and the core 22 may be inserted into the liner trailing end portion 16 of the jacket 24, either before or after the liner 12 is inserted into the jacket 24. The assembled projectile 10 may then be inserted into the cartridge case 64.

The cartridge case 64 includes a cylindrical case body 66 forming a case void 68. The case void 68 has a volume sufficient to enclose an explosive charge (not shown), and to receive the trailing end portion of the projectile 10 therein. A case retention ring 70 engages the jacket retention groove 60 of the jacket 24 to secure the projectile 10 within the case body 66. The cartridge case 64 may also include a case rim 72 for facilitating loading the projectile 10 into a firearm (not shown), as is known in the art.

It should be understood that the above-described embodiment may react differently under different impact conditions. For example, the penetration and fragmentation properties of the projectile 10 may differ based on the type of material, the thickness, and/or the angle of approach of the projectile 10 with respect to the target object. Examples pertaining to different combinations of conditions are described below with respect to FIGS. 3A-6H.

Figures 3A, 3B, 3C, 3D:
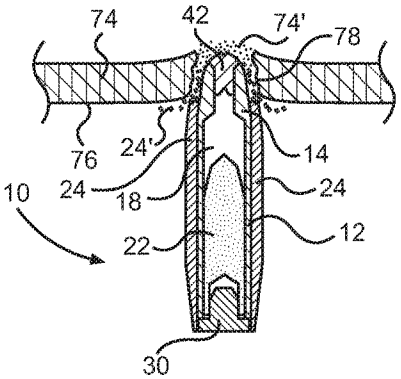
FIGS. 3A-3D illustrate the projectile of FIGS. 1 and 2 impacting and penetrating a target surface in a direction of flight substantially normal to the target surface.

In this regard, referring now to FIGS. 3A-3D, diagrams of the projectile 10 of FIGS. 1 and 2 impacting and penetrating a target object 74, such as armor plating, for example, in a direction of flight substantially normal to a target surface 76 are illustrated. In this regard, FIG. 3A illustrates the projectile 10 immediately prior to impacting the target surface 76. In this example, the direction of flight is in a substantially upward direction with respect to FIGS. 3A-3D.

Referring now to FIG. 3B, the jacket leading end portion 50 of the jacket 24 is partially fragmented (see fragmented portions of jacket 24') and eroded away from the liner leading end portion 14 of the liner 12, and the cap 42 and liner leading end portion 14 of the liner 12 are in the process of penetrating through and fragmenting a portion of target object 74 (see fragmented portions of target object 74'), thereby forming a channel 78 through the target object 74. Referring now to FIG. 3C, the liner leading end portion 14 of the liner 12 and the cap 42 have partially broken away from the remainder of the projectile 10 and have lost momentum as a result of penetrating the target object 74. It can be seen, however, that the core 22 has separated from the plug 30 (see fragmented portions of plug 30'), and has experienced less of a reduction in momentum. In this manner, the core 22 is able to penetrate the fragmented portions of the target object 74' and the fragmented portions of the liner 12' and pass through the channel 78 in the target object 74 to penetrate the target object 74 with less of a reduction in velocity than the reduction in velocity of the cap 42 and the liner 12. Referring now to FIG. 3D, it can be seen that the core 22 continues through the channel 78 of the target object 74 and continues along the direction of flight with a relatively high velocity. In this manner, the dense core 22 of the projectile 10 exits the channel 78 with a relatively high velocity and lethality.

Figure 4A:
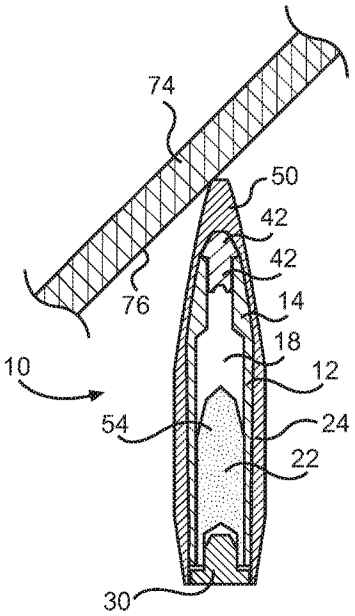
FIGS. 4A-4E illustrate the projectile of FIGS. 1 and 2 impacting and penetrating a target surface in a direction of flight at a non-zero angle of approach with respect to the normal of the target surface.
Figure 4B:
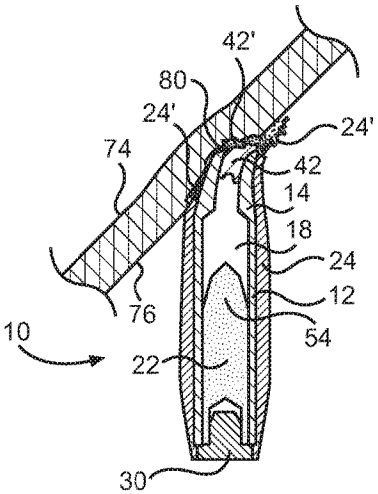

Referring now to FIGS. 4A-4E, cross-sectional diagrams of the projectile 10 impacting and penetrating the target object 74 in a direction of flight at a non-zero angle of approach with respect to the normal of the target surface 76 are illustrated. In this example, the projectile 10 impacts the target object at an angle of approach of approximately 45 degrees. In this regard, FIG. 4A illustrates the projectile 10 immediately before impact with the target object 74. FIG. 4B illustrates the jacket leading end portion 50 of the jacket 24, the cap leading end portion 48 of the cap 42, and the liner leading end portion 14 of the liner 12 impacting the target surface 76 of the target object 74 at the substantially 45 degree angle of approach. In this example, the impact of the jacket leading end portion 50, the cap leading end portion 48, and the liner leading end portion 14 is not sufficient to fully penetrate the target object 74. Instead, the projectile 10 creates a deformation 80 in the target surface 76 of the target object 74, with the liner leading end portion 14, jacket leading end portion 50, and cap leading end portion 48 being partially shattered (see fragmented portions of cap 42' and jacket 24') and/or deformed away from the target surface 76 of the target object 74.

Figure 4C:
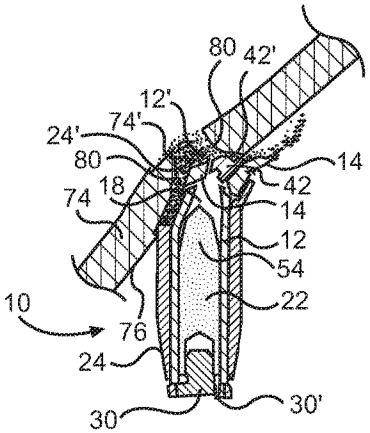
Figure 4D:
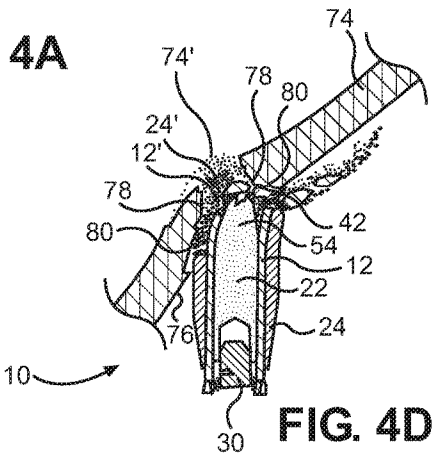
Figure 4E:
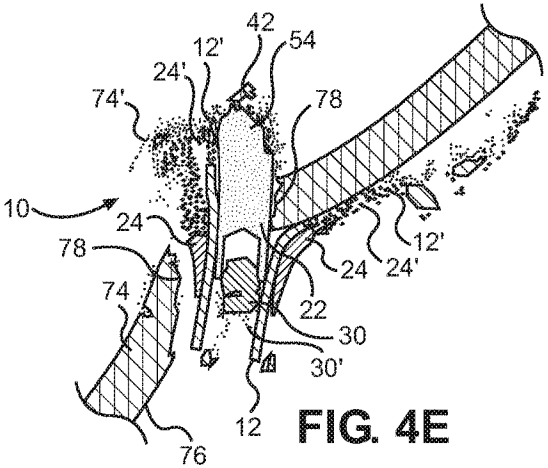
Figures 5A, 5B, 5C, 5D, 5E, 5F, 5G, 5H:
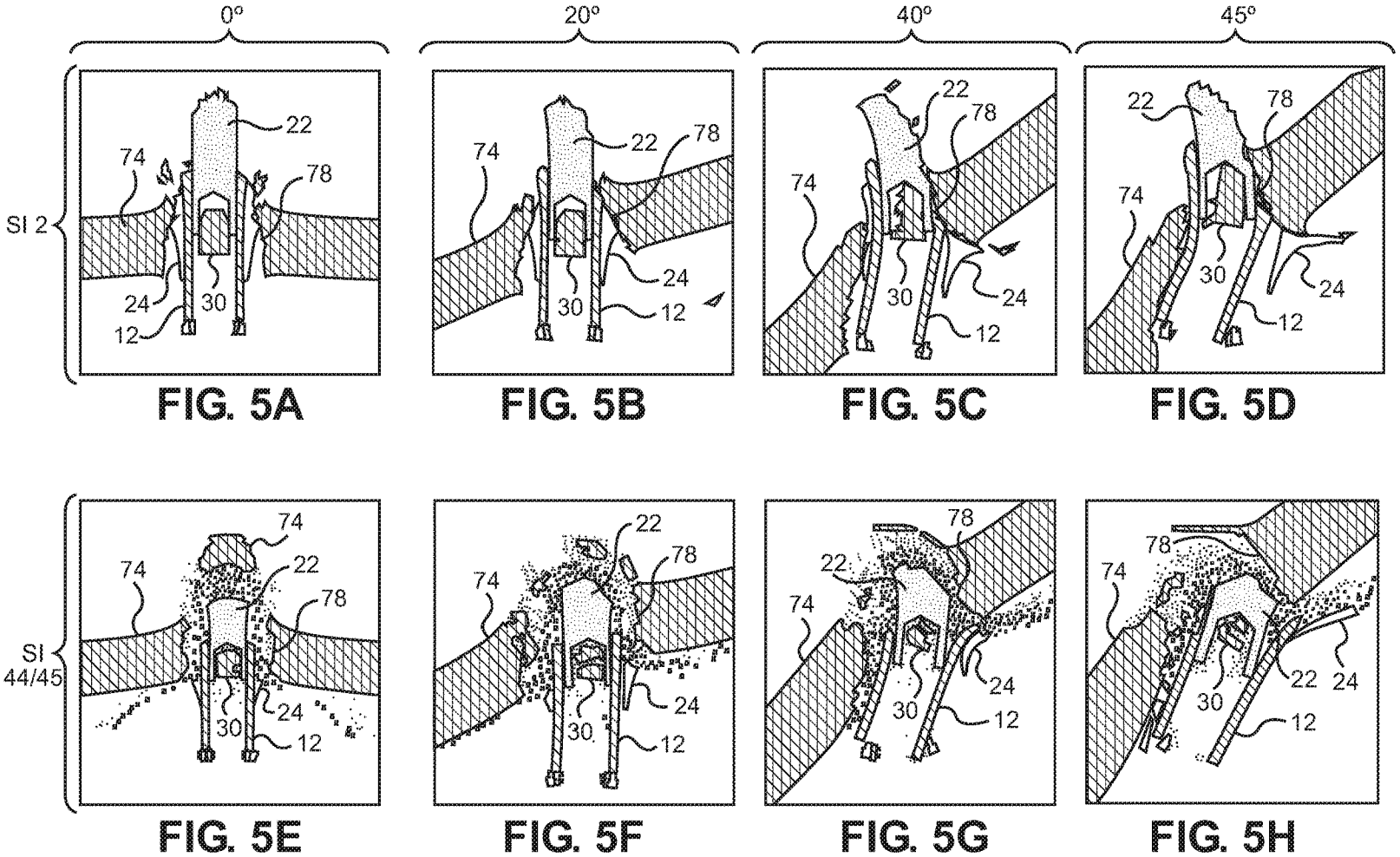
FIGS. 5A-5H illustrate the projectile of FIGS. 1 and 2 impacting a plurality of target surfaces having different compositions at a plurality of different angles of approach.
Figures 6A, 6B, 6C, 6D, 6E, 6F, 6G, 6H:
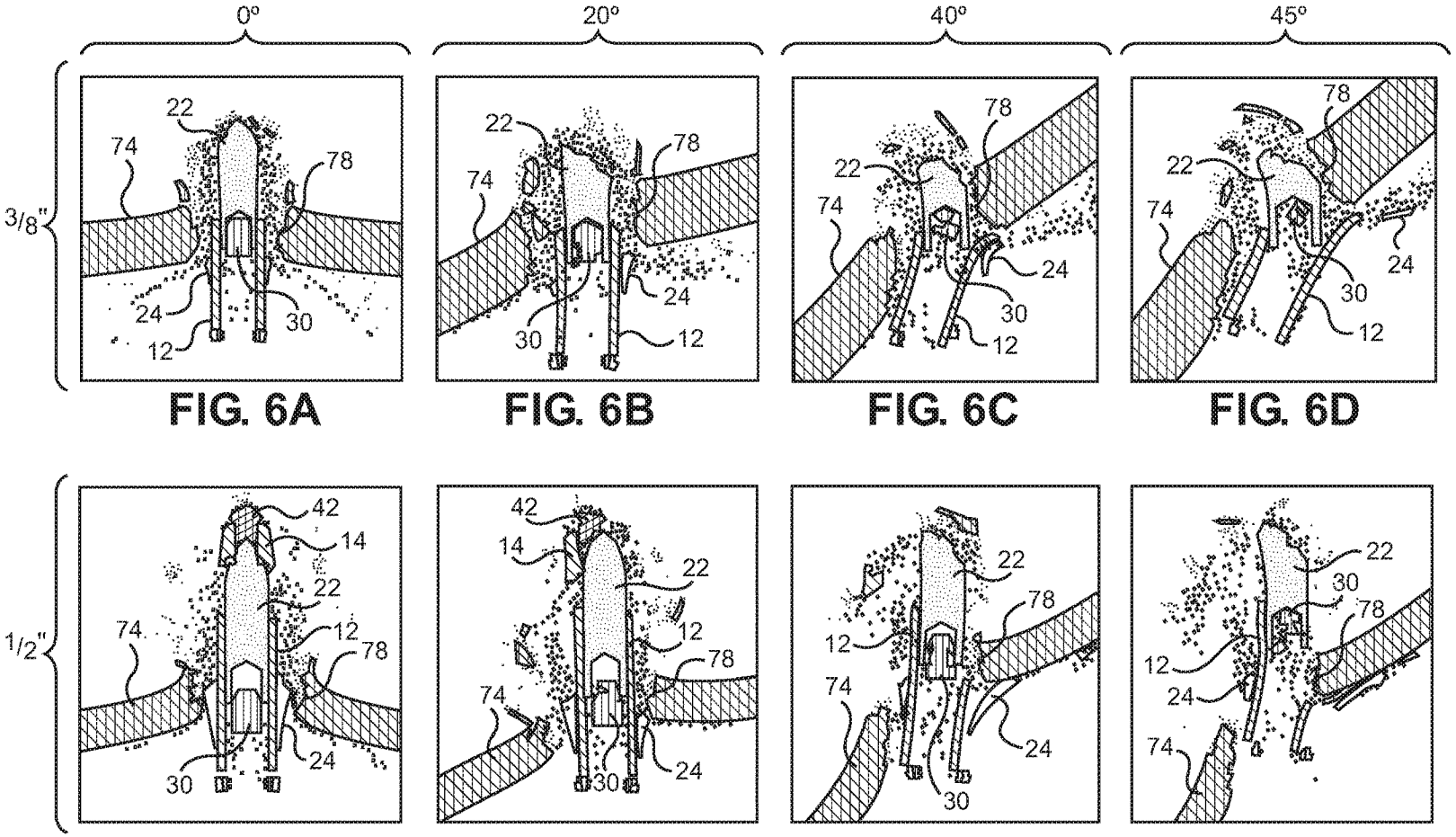
FIGS. 6A-6H illustrate the projectile of FIGS. 1 and 2 impacting a plurality of target surfaces having different thicknesses at a plurality of different angles of approach.

Referring now to FIG. 4C, the jacket leading end portion 50 has fragmented and eroded away from the liner leading end portion 14, and the liner leading end portion 14 and the cap 42 have fragmented and expanded the deformation 80, and the core 22 continues to travel in the direction of flight toward the target object 74. As shown in FIG. 4D, by the time the core leading end portion 54 of the core 22 reaches the target surface 76 of the target object 74, the deformation 80 of the target surface 76 has substantially enlarged, and has begun to define a channel 78 through the target object 74. Referring now to FIG. 4E, the core 22, which had not experienced the same loss of momentum as the liner leading end portion 14, for example, punches through the deformation 80 and passes through the channel 78 to penetrate the target object 74.

The embodiments described herein may function differently in different use cases, and may be tailored to have different levels, i.e., general utility or specific utility, for different use cases. In this regard, FIGS. 5A-5H illustrate the projectile 10 of FIGS. 1 and 2 impacting a plurality of target objects 74 having different compositions at a plurality of different angles of approach. FIGS. 5A-5D illustrate the projectile 10 impacting a target object 74 formed from ⅜"-thick SI 2 type steel, at respective zero degree, twenty degree, forty degree, and forty-five degree angles of approach. In this embodiment, the projectile 10 is well suited to cleanly penetrating the target object 74, even at relatively high angles of approach. FIG. 5E-5H illustrate the projectile 10 impacting a target object 74 formed from SI 44/45 type steel, which is generally harder and more impact resistant than SI 2 type steel. In this embodiment, the projectile 10 still has superior penetration capabilities at angles of approach of zero degrees, but the penetration effectiveness of the projectile 10 tapers off as the angle of approach increases to twenty degrees, forty degrees, and forty-five degrees. However, even at an angle of approach of forty-five degrees, which would typically cause a conventional projectile to ricochet off of a hard target, the projectile 10 is nevertheless able to at least partially penetrate and fragment within the target object 74.

FIGS. 6A-6H illustrate the projectile 10 of FIGS. 1 and 2 impacting a plurality of target objects 74 having different thicknesses at a plurality of different angles of approach. Similar to the examples of FIGS. 5A-5H, FIGS. 6A-6D illustrate the projectile 10 impacting a target object 74 formed from ⅜"-thick steel, at respective zero degree, twenty degree, forty degree, and forty-five degree angles of approach. FIGS. 6E-6H illustrate the projectile 10 impacting a target object 74 formed from ½"-thick steel, at respective zero degree, twenty degree, forty degree, and forty-five degree angles of approach. As would be expected, the projectile 10 has superior penetration for the thinner target object 74 of FIGS. 6E-6H, but it can be seen that the projectile 10 can nevertheless penetrate the thicker target object 74 of FIG. 6D, at a relatively high forty-five degree angle of approach.

Figure 7:
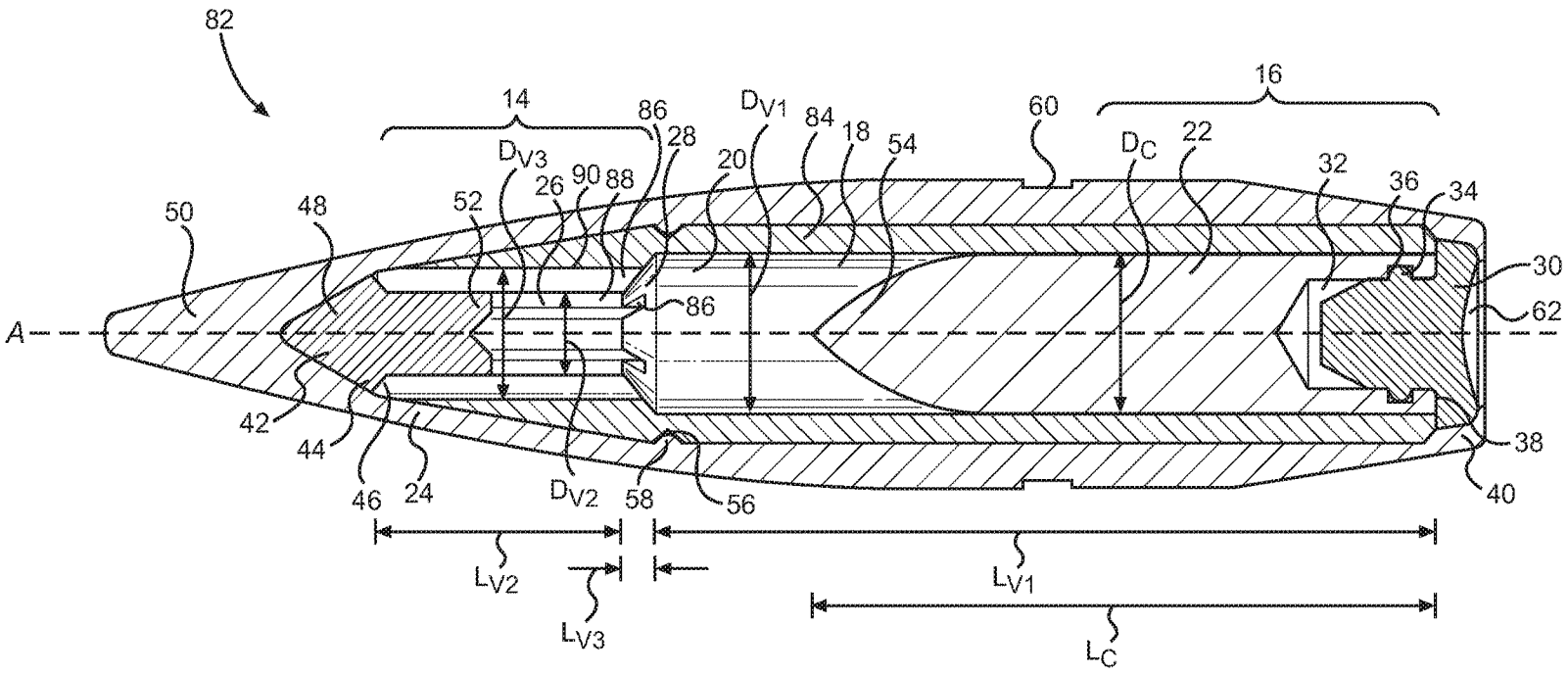
FIG. 7 illustrates a cross-sectional side view of a projectile according to an alternative embodiment, the projectile comprising a plurality of radial grooves in a forward void region configured to fragment in a controlled manner when the core travels through the forward void region.

As discussed above, fragmentation properties may also be desirable, in addition to penetration properties. In this regard, FIG. 7 illustrates a cross-sectional side view of a projectile 82 according to an alternative embodiment. In this embodiment, many of the features of the projectile 82 correspond to analogous features of projectile 10 of FIG. 1. In addition, the projectile 82 includes a plurality of radially extending grooves 86 formed in the second void region 26. These grooves 86 define an inner void surface 88 having the diameter $D_{V2}$ and an outer void surface 90 defined by outer ends of the grooves 86, the outer void surface 90 having a diameter $D_{V3}$. In this embodiment, as the core 22 travels in the direction of flight through the liner leading end portion 14, the grooves 86 provide weakened portions of the liner leading end portion 14 extending generally along the longitudinal axis A, thereby causing the liner leading end portion 14 to fragment in a more controlled and uniform manner when the projectile 82 impacts a target object (not shown).

Figure 8B:
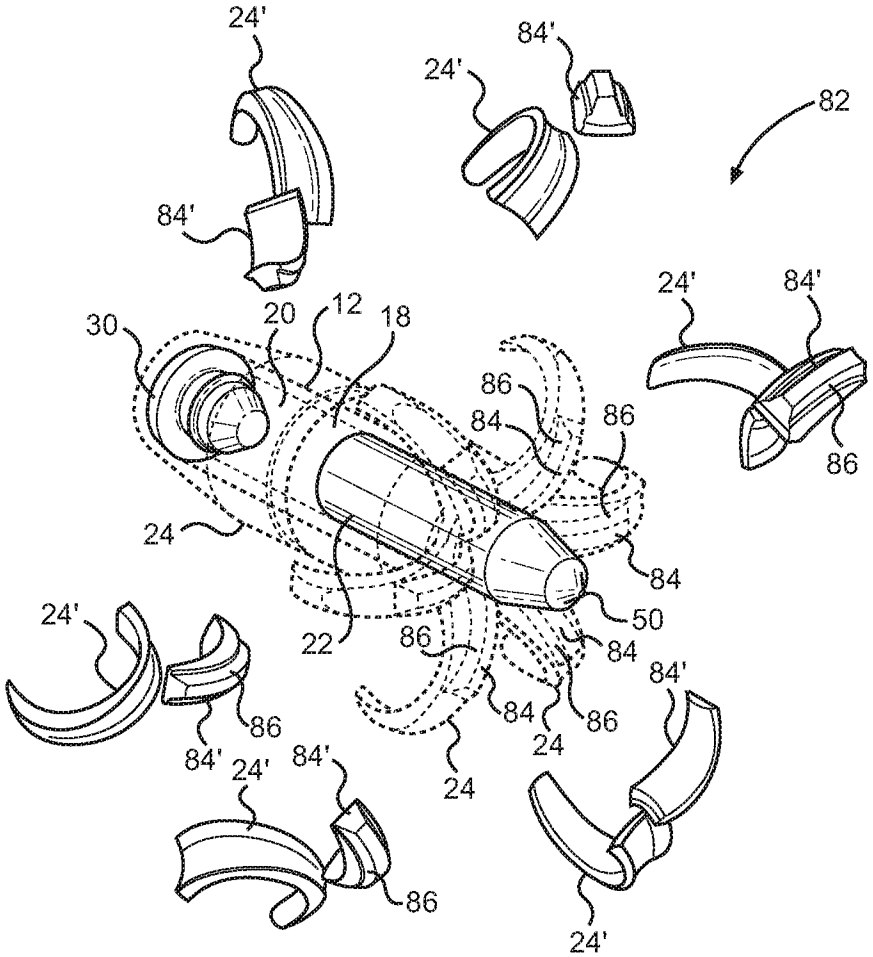
FIG. 8B illustrates an isometric view of the projectile of FIG. 8A fragmenting in response to impacting a target.
Figure 8A:
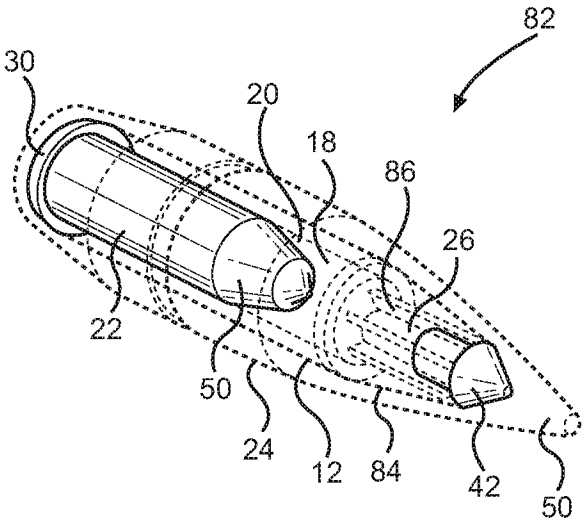
FIG. 8A illustrates an isometric view of the projectile of FIG. 7.

In this regard, FIG. 8A illustrates an isometric view of the projectile 82 of FIG. 7, and FIG. 8B illustrates an isometric view of the projectile 82 fragmenting in response to impacting a target object (not shown). As can be seen in FIG. 8B, the core 22 travels in the direction of flight through the liner leading end portion 14, thereby expanding the second void region 26 and the liner leading end portion 14 radially outwardly. The grooves 86 split apart before other portions of the liner leading end portion 14, and cause fragments of the liner 84' and the jacket 24' to tear away from each other relatively uniformly in a radially outward direction.

Figure 9:
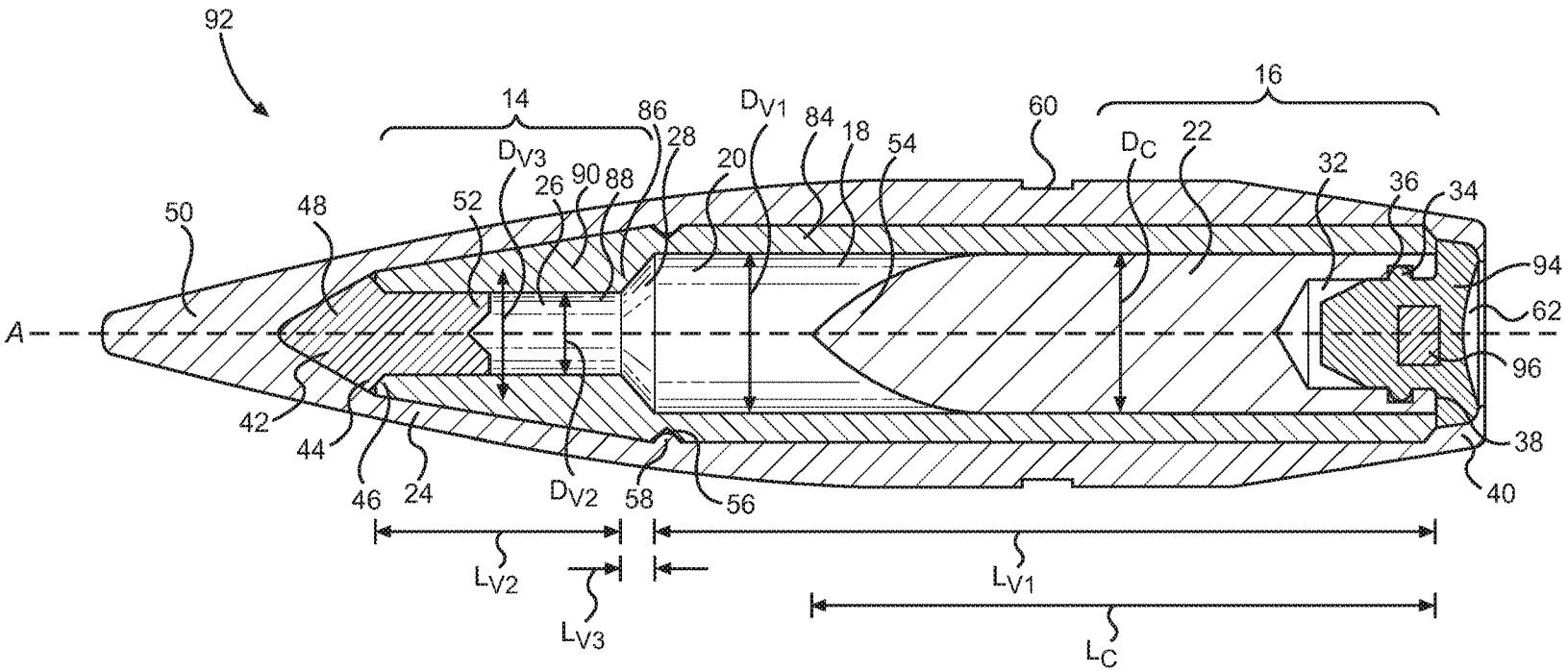
FIG. 9 illustrates a cross-sectional side view of a projectile according to an alternative embodiment, the projectile containing a payload enclosed in a boattail plug of the projectile.

It may also be desirable to include additional components, such as an additional payload, to enhance the utility of the projectiles disclosed herein. In this regard, FIG. 9 illustrates a cross-sectional side view of a projectile 92 according to an alternative embodiment. In this embodiment, the projectile 92 contains a modified boattail plug 94 having a payload 96 enclosed therein. The payload may be a sensor and/or an explosive charge, as desired.

Figure 10:
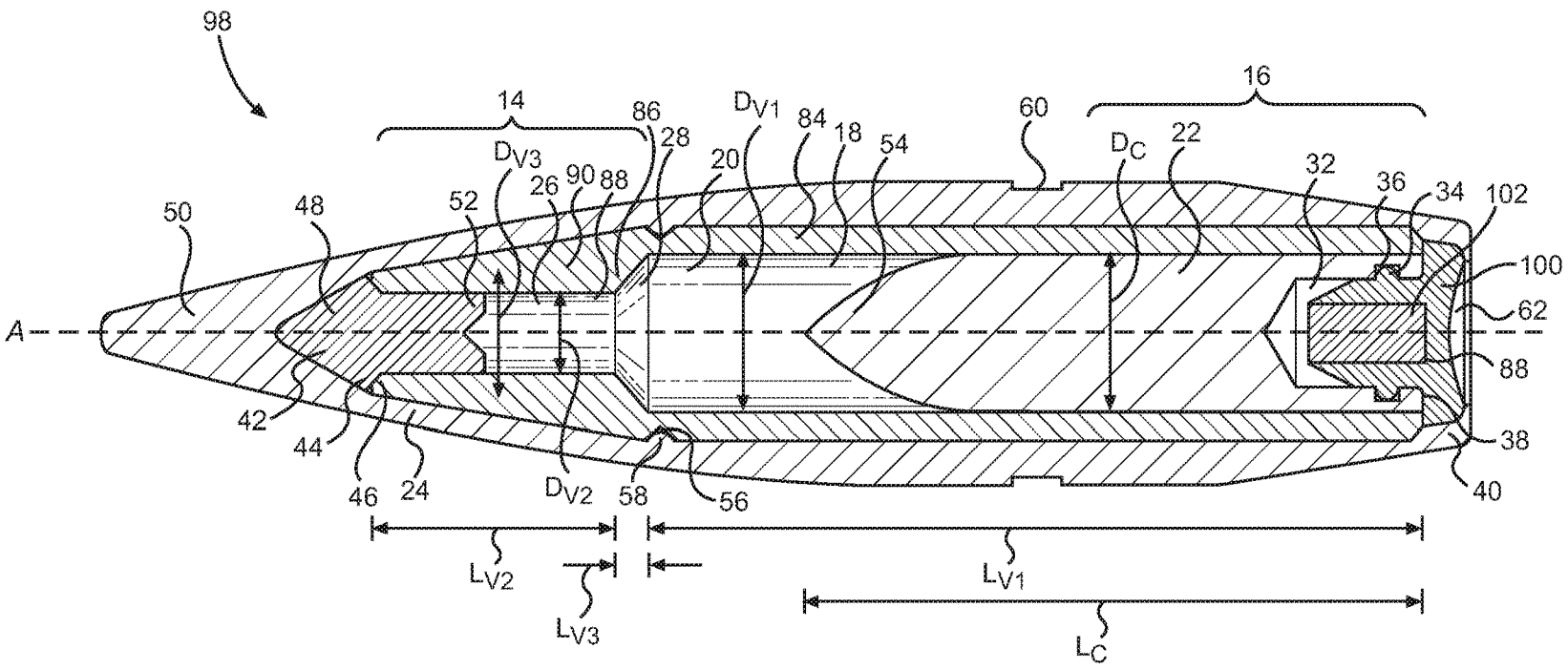
FIG. 10 illustrates a cross-sectional side view of a projectile according to an alternative embodiment, the projectile containing a payload enclosed in a void of the core by a boattail plug of the projectile.

FIG. 10 illustrates a cross-sectional side view of a projectile 98 according to an alternative embodiment. In this embodiment, the projectile 98 contains an alternative modified boattail plug 100 configured to hold a payload 102, with the payload in communication with the core void 32.

Figure 11:
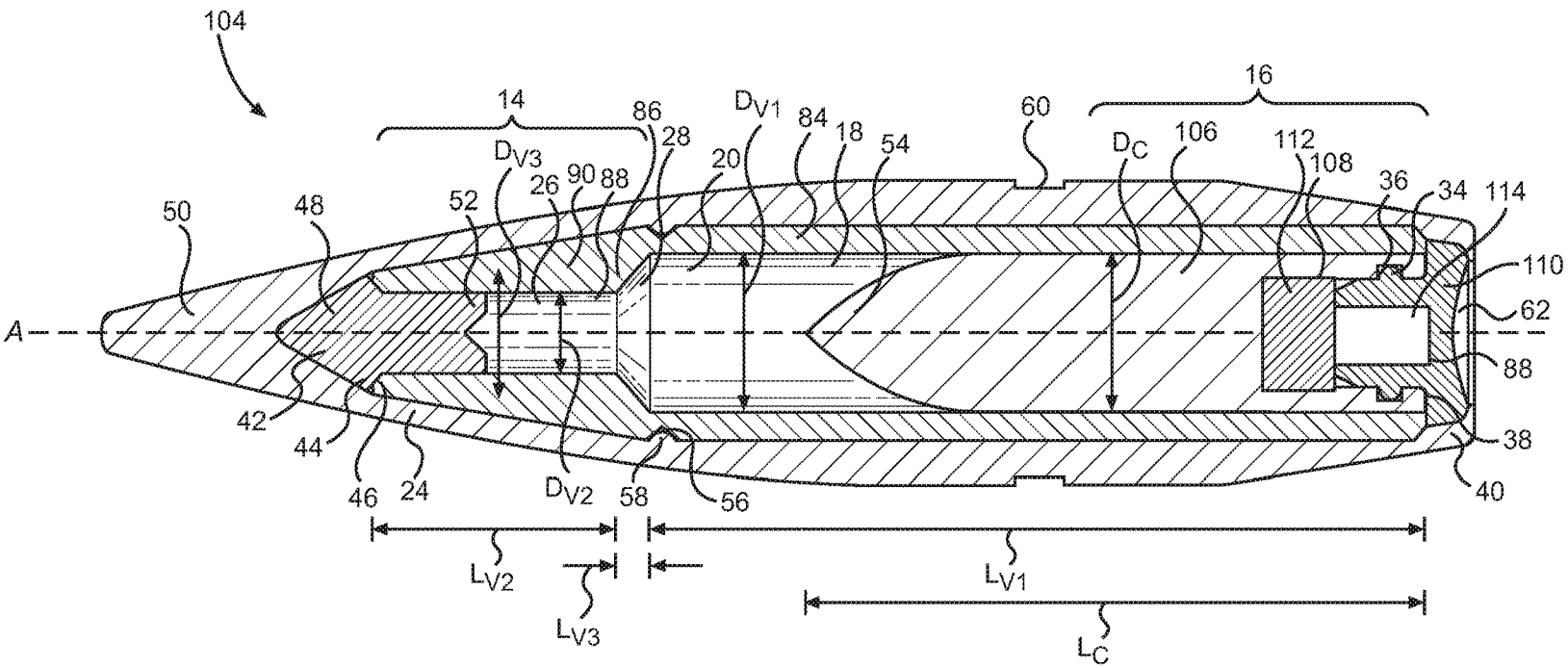
FIG. 11 illustrates a cross-sectional side view of a projectile according to an alternative embodiment, the projectile containing a payload enclosed in a boattail plug of the projectile, the boattail plug comprising a plug void for enclosing a secondary explosive charge.

FIG. 11 illustrates a cross-sectional side view of a projectile 104 according to an alternative embodiment. In this embodiment, the projectile has a modified core 106 having an enlarged core void 108. An alternative boattail plug 110 encloses a payload 112 in the core void 108. In this embodiment the boattail plug includes a plug void 114 configured to carry an additional component, such as, for example, a secondary explosive charge (not shown).

Figure 12:
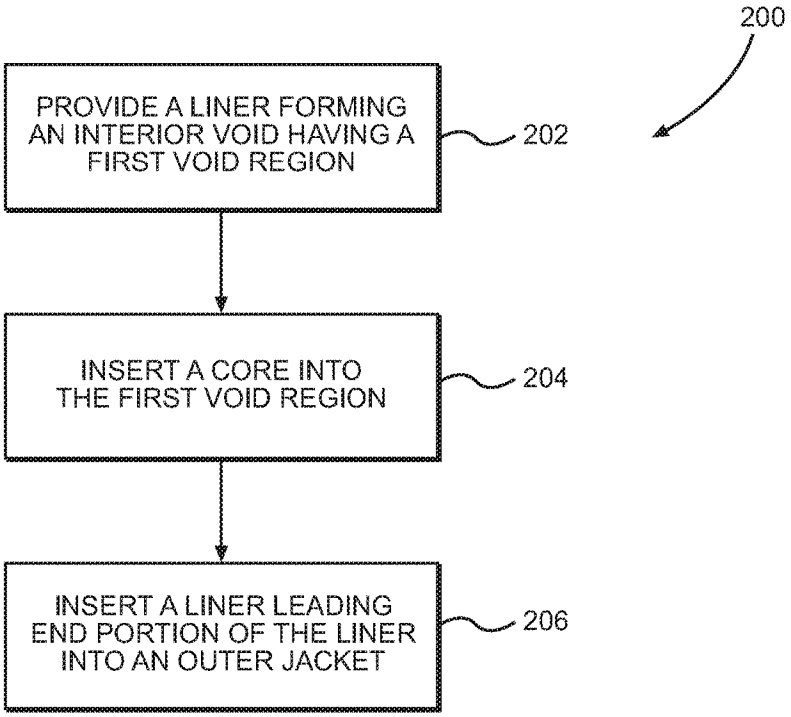
FIG. 12 illustrates a flowchart of an exemplary method of assembling a projectile according to a simplified embodiment.

FIG. 12 illustrates a flowchart of a simplified method 200 of assembling a projectile, such as, for example, the projectile 10 of FIGS. 1 and 2. The method 200 includes providing a liner, such as liner 12, having a liner leading end portion and a liner trailing end portion and having a longitudinal axis (Block 202). The liner forms an interior void having a first void region having a first void cross-sectional diameter perpendicular to the longitudinal axis, a first void length, and a first void volume. The method 200 further comprises inserting a core, such as core 22, into the first void region at the liner trailing end portion (Block 204). The core has a maximum core cross-sectional diameter no greater than the first void cross-sectional diameter, a core length less than the first void length, and a core volume less than the first void volume. The method 202 further comprises inserting the liner leading end portion into an outer jacket, such as jacket 24 to cover the liner leading end portion (Block 206).

Figure 13D:
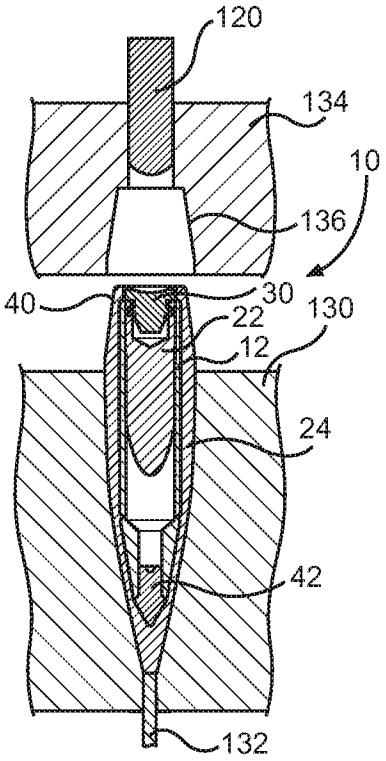
FIGS. 13A-13D illustrates assembly of a projectile according to an embodiment similar to the method of FIG. 12, with additional details.
Figure 13C:
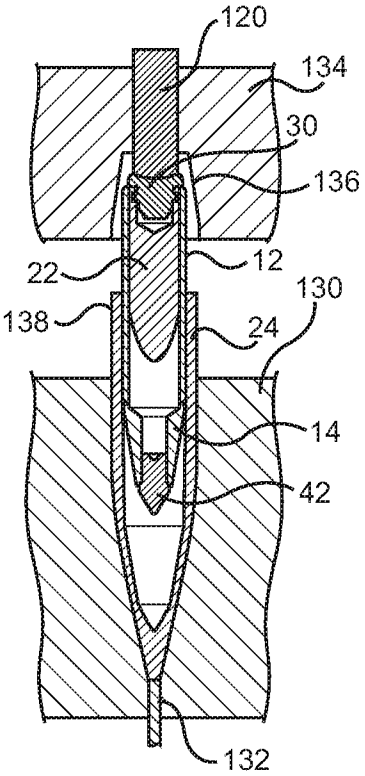
Figure 13B:
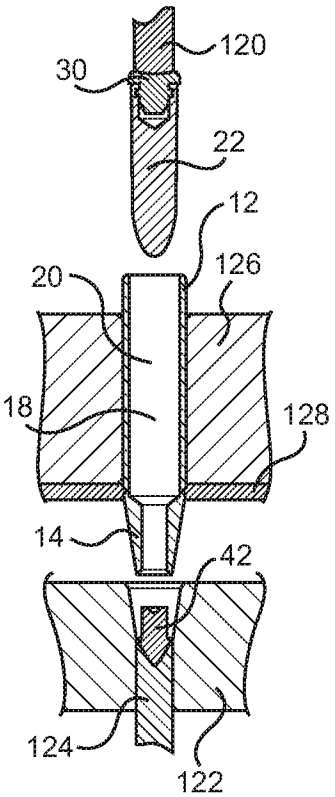
Figure 13A:
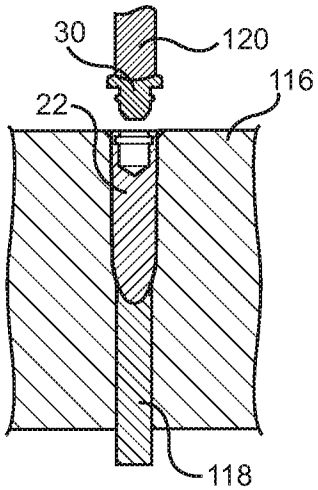
Figure 14:
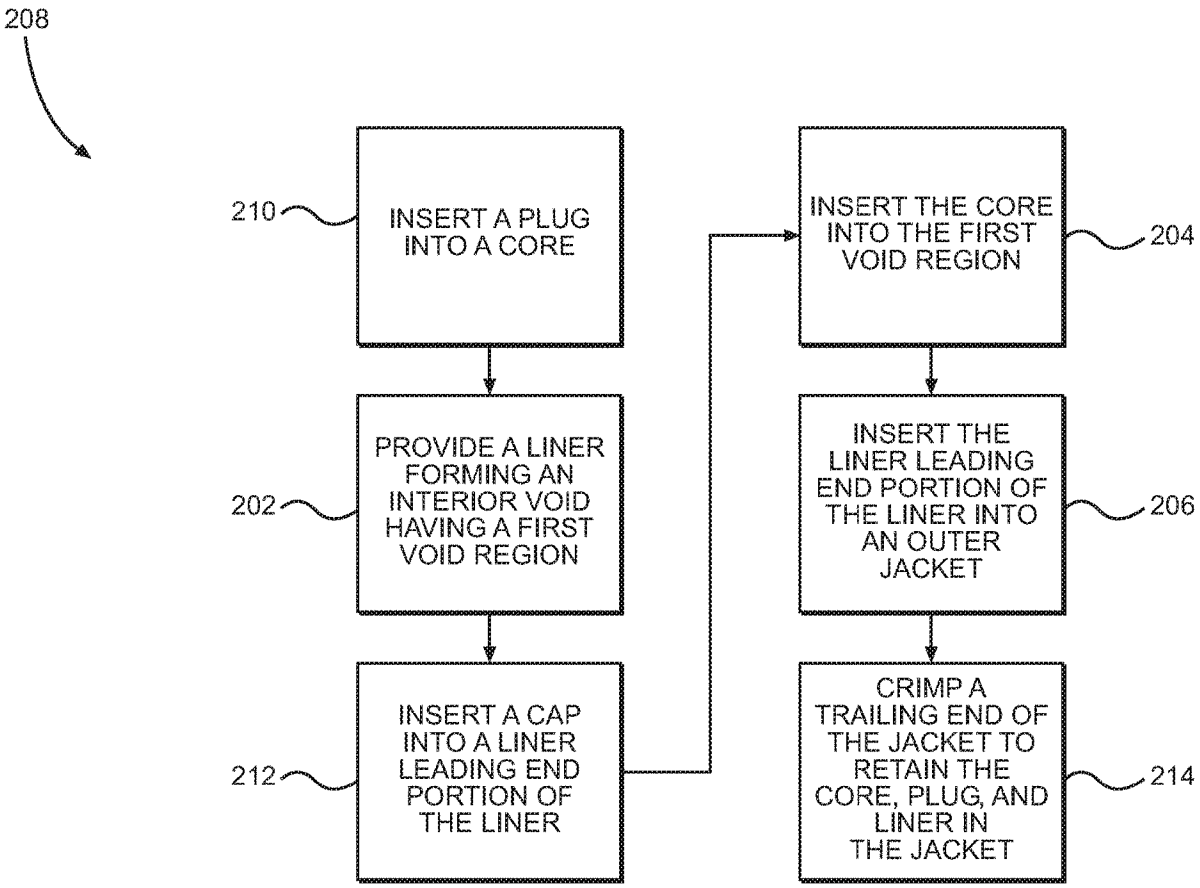
FIG. 14 illustrates a flowchart of the method of assembling the projectile according to the embodiment of FIGS. 13A-13D.

It should be understood that assembly of an exemplary projectile may include additional details and steps, as desired. In this regard, FIGS. 13A-13D illustrate assembly of a projectile 10 according to an embodiment similar to the method of FIG. 12, with additional details. The description of FIGS. 13A-13D below also makes reference to FIG. 14, which illustrates a flowchart of a method 208 of assembling the projectile. The method 208 shown by FIG. 14 includes the steps 202, 204, 206 of the method 200 of FIG. 12, as well as additional steps and details. In this regard, FIG. 13A illustrates insertion of the plug 30 into the core 22 (Block 210 of FIG. 14). The core 22 is disposed in a die block 116 with a lower pin 118, and the plug 30 is held by and pressed into place by an upper pin 120. FIG. 13B illustrates providing the liner 12 forming an interior void 18 having a first void region 20 (Block 202 of FIG. 14) and inserting the cap 42 into the liner leading end portion 14 of the liner 12 (Block 212 of FIG. 14). The cap 42 is disposed in a die block 122 with a lower pin 124, and the liner 12 is disposed in a die block 126 and is held in place by a collar 128. FIG. 13B also illustrates inserting the core 22 into the first void region 20 of the void 18 of the liner 12 (Block 204 of FIG. 14), via the upper pin 120. FIG. 13C illustrates inserting the liner leading end portion 14 of the liner 12 into the jacket 24 (Block 206 of FIG. 14). The jacket 24 is held by a lower die block 130 and a lower pin 132. An upper die block 134 is lowered with the upper pin 120 to press the liner 12 into the jacket 24. The upper die block 134 includes a tapered recess 136 that crimps the trailing end 138 of the jacket 24 to form the crimped trailing end 40, thereby retaining the core 22, plug 30, and liner 12 in the jacket 24 (Block 214 of FIG. 14). Finally, as shown by FIG. 13D, the upper die block 134 and upper pin 120 are removed to allow removal of the assembled projectile 10.

Those skilled in the art will recognize improvements and modifications to the preferred embodiments of the disclosure. All such improvements and modifications are considered within the scope of the concepts disclosed herein and the claims that follow.

What is claimed is:

1. A projectile comprising:

a liner comprising a liner leading end portion and a liner trailing end portion and having a longitudinal axis, the liner forming an interior void having a first void region, the first void region having a first void cross-sectional diameter perpendicular to the longitudinal axis, a first void length, and a first void volume;

a core disposed in the first void region proximal to the liner trailing end portion, the core having a maximum core cross-sectional diameter no greater than the first void cross-sectional diameter, the core having a core length less than the first void length, and the core having a core volume less than the first void volume; and an outer jacket covering the liner leading end portion.

2. The projectile of claim 1, wherein the core is configured to travel in a direction of flight through the liner leading end portion to impact an object in response to the projectile impacting the object.

3. The projectile of claim 1, wherein the interior void further comprises a second void region proximal to the liner leading end portion, the second void region having a second void cross-sectional diameter perpendicular to the longitudinal axis, the second void cross-sectional diameter less than the maximum core cross-sectional diameter.

4. The projectile of claim 3, wherein the core is configured to travel in a direction of flight through the second void region to impact an object in response to the projectile impacting the object.

5. The projectile of claim 4, wherein the liner leading end portion comprises a plurality of weakened portions configured to fragment the liner leading end portion in response to the core traveling through the liner leading end portion.

6. The projectile of claim 1, wherein the jacket has a jacket hardness, the liner has a liner hardness and a liner density, and the core has a core density, the liner hardness being greater than the jacket hardness, and the core density being greater than the liner density.

7. The projectile of claim 1, wherein the core comprises a core leading end portion having a tapered profile.

8. The projectile of claim 1, further comprising a cap disposed between the jacket and the interior void.

9. The projectile of claim 8, wherein the cap is configured to shatter in response to the projectile impacting an object.

10. The projectile of claim 8, wherein the jacket has a jacket hardness, the liner has a liner hardness and a liner density, the cap has a cap hardness and a cap density, and the core has a core density, the liner hardness being greater than the jacket hardness, the cap hardness being greater than the jacket hardness, the core density being greater than the liner density, and the core density being greater than the cap density.

11. The projectile of claim 10, wherein the cap density is substantially equal to the liner density, and the cap hardness is substantially equal to the liner hardness.

12. The projectile of claim 1, further comprising a plug coupled to the core proximal to the liner trailing end portion, the plug and the jacket enclosing the liner and the core.

13. The projectile of claim 12, wherein the plug is configured to separate from the core in response to the projectile impacting an object.

14. The projectile of claim 12, wherein the jacket has a jacket hardness, the liner has a liner hardness and a liner density, the core has a core density, and the plug has a plug density, the liner hardness being greater than the jacket hardness, the core density being greater than the liner density, and the core density being greater than the plug density.

15. The projectile of claim 1, wherein the projectile is devoid of lead and spent uranium-238.

16. The projectile of claim 1, wherein the projectile is configured to be disposed in a cartridge.

17. The projectile of claim 1, wherein the jacket and the liner leading end portion are configured to create a deformation in an object in response to the projectile impacting the object, and the core is configured to travel in a direction of flight through the liner leading end portion to impact the deformation in response to the projectile impacting the object.

18. A projectile comprising:

a liner having a liner leading end portion, the liner forming an interior void; and a core completely disposed in the interior void, the core configured to impact the liner leading end portion in response to the projectile impacting an object, the core configured to impact the liner leading end portion after the projectile impacts the object;

wherein a portion of the interior void is disposed between the core and a leading end portion of the projectile.

19. A method of assembling a projectile comprising:

providing a liner comprising a liner leading end portion and a liner trailing end portion and having a longitudinal axis, the liner forming an interior void having a first void region, the first void region having a first void cross-sectional diameter perpendicular to the longitudinal axis, a first void length, and a first void volume;

inserting a core into the first void region at the liner trailing end portion, the core having a maximum core cross-sectional diameter no greater than the first void cross-sectional diameter, the core having a core length less than the first void length, and the core having a core volume less than the first void volume; and inserting the liner leading end portion into an outer jacket to cover the liner leading end portion.

* * * * *